US006346919B1

(12) United States Patent
Wang et al.

(10) Patent No.: US 6,346,919 B1
(45) Date of Patent: Feb. 12, 2002

(54) DUAL BAND AND MULTIPLE BAND ANTENNA

(75) Inventors: Daniel Wang; Robert Daly, both of North Rocks (AU)

(73) Assignee: RF Industries Pty Ltd., North Rocks (AU)

( * ) Notice: Subject to any disclaimer, the term of this patent is extended or adjusted under 35 U.S.C. 154(b) by 0 days.

(21) Appl. No.: 09/633,394

(22) Filed: Aug. 7, 2000

(30) Foreign Application Priority Data

Aug. 5, 1999 (AU) ..... PQ2045

(51) Int. Cl.[7] ..... H01Q 13/10
(52) U.S. Cl. ..... 343/767; 343/769; 343/700 MS
(58) Field of Search ..... 343/700 MS, 713, 343/715, 767, 769

(56) References Cited

U.S. PATENT DOCUMENTS 4,839,660 A 6/1989 Hadzoglou ..... 343/715
5,245,745 A * 9/1993 Jensen et al. ..... 343/700 MS
5,646,634 A * 7/1997 Bokhari et al. ..... 343/700 MS
5,898,408 A * 4/1999 Du ..... 343/715
6,097,345 A * 8/2000 Walton ..... 343/700 MS
6,172,651 B1 * 1/2001 Du ..... 343/715

FOREIGN PATENT DOCUMENTS

AU 57744/94 1/1995
WO WO 96/09661 3/1996

* cited by examiner

*Primary Examiner*—Tho Phan
*Assistant Examiner*—Hoang Nguyen
(74) *Attorney, Agent, or Firm*—Baker & Daniels

(57) ABSTRACT

An RF antenna capable of operating on two or more, unrelated frequency is disclosed. The antenna has a slot element 20 and a patch element 30 with an intermediate dielectric 63, and the patch element acts to tune the resonant frequency of the antenna 10.

28 Claims, 4 Drawing Sheets

| 1: MKR (MHz) | | 2: MKR (MHz) dB |
|---|---|---|
| 1: 806.0000 | 1.903 | |
| 2: 960.0000 | 1.584 | |
| 3> 1710.0000 | 1.374 | |
| 4: 1990.0000 | 1.825 | |
| 5: 820.0000 | 1.505 | |

DUAL BAND AND MULTIPLE BAND ANTENNA

FIELD OF THE INVENTION

The present invention relates to antenna devices, and, more particularly to dual or multiple band antenna devices adapted for mounting on glass or similar dielectric surfaces.

The invention has been developed primarily for use in PDS, CDMA, TDMA, AMPS and GSM telecommunication system and will be described herein after with respect to that application. However, the invention is not limited to that particular field of use and is also applicable to in-vehicle and other portable and stationary applications, other telecommunications systems as well as GPS navigation systems.

BACKGROUND ART

Vehicle mounted antenna devices of various sorts have been used to receive UHF and other band signals for many years. One known device utilises external whip antennas which are capacitively or inductively linked to a coupling unit inside the glass, which in turn is linked to a cellular phone or other transmitting and/or receiving apparatus.

Another known device involves a generally planar antenna adhered to the inside of the window. Most previously known devices were designed to function with only a single frequency band—for example, the prevailing cellular telephone frequency, typically about 800–900 MHz.

Increasingly, however, demand exists for such an antenna which is capable of dual band and/or multiple band operation. One aspect of this demand relates to dual band GSM telephone standards, which operate on 900 and 1800 MHz in Austrialia, most of Europe and much of Asia. In addition, many nations (including Australia, the Americas and much of Asia) also operate cellular telephony in the 800 MHz and 1900 MHz bands. Such cellular telephony systems also include PDS, TDMA, CDMA and AMPS systems.

Some dual band vehicle and non-vehicle mounted antenna devices have been proposed, providing varying degrees of suitability. However, the dual bands to which the antenna is resonant are generally related, for example, as multiples or harmonics. It is important to appreciate that in many of these applications it is necessary not just to receive but also to transmit.

Typically, known dual band devices have operated by exciting two resonant frequencies by means of either a single feed or a power divider/phase shifter combining the frequencies into a single port.

A further issue with many existing dual band devices is that they are relatively complicated and expensive. Some known antennas in use have used planar or similar circuits which are inherently broadband, however, their effectiveness in the field has been poor with the antennas exhibiting poor performance and, as a result, limited market acceptance.

SUMMARY OF THE INVENTION

It is an object of the present invention to provide an effective dual band and/or multiple band antenna, in which the separate bands need not have a particular relationship to one another. A further object of the present invention is to provide a simple and economical construction for such a dual band or multiple band antenna.

According to a first aspect of the invention there is provided an antenna device including:

a first conductive element having a slot which forms a closed path and includes a section of conductive material disposed in a portion of the slot;

a second conductive element disposed adjacent the first element and having a central opening and a strip opening extending from the central opening to some predetermined length beyond the edge of the opening, a conductive strip feed element disposed in the strip opening and at least two patch elements of predetermined dimensions which function as notch circuits and are generally radially inwardly extending into the central opening;

a dielectric insulator disposed intermediate the conductive elements such that, in use, the device has at least two frequency bands to receive and/or transmit RF signals.

Preferably, the first and second conductive elements and the dielectric insulator are generally planar and include a pair of major faces. More preferably, the first and second conductive elements are bonded to respective major faces of the dielectric insulator. More preferably, the first and second conductive elements are integrally formed on respective major faces of the dielectric insulator.

Preferably the slot is substantially circular and defines an annulus. Also preferable, the slot has a substantially uniform thickness and may be assymmetrical.

Preferably, the dielectric insulator is a PCB material.

Preferably, the central opening is substantially circular..

More preferably, the device is for use in CDMA, TDMA, PCS, third generation mobile and/or AMPS telecommunications systems, UHF and/or VHF television systems, and/or GPS satellite navigation systems.

Preferably, the device is removably encased in a dielectric material.

According to another aspect of the invention there is provided an antenna device including:

a slot antenna having a closed path slot; a patch element; and a dielectric material disposed intermediate the slot antenna and patch element wherein the patch element is selectively configured such that the resonant frequency of the slot antenna is altered allowing the device to transmit and/or receive RF signals over at least two frequency bands.

Preferably, the patch element functions as a notch circuit. Preferably, the patch element includes at least four notches, preferably of different shapes. Preferably, the device, in use, transmits and/or receives RF signals over four frequency bands.

Preferably, the notch circuit, slot antenna and dielectric material are all generally planar and may be integrally formed. Preferable also, the notch circuit and slot antenna are respectively bonded to the dielectric material.

Preferably, the slot is circular and defines an annulus. More preferably, the slot has non-uniform thickness.

The principles of annular slot antennas are a well known in the art and are particularly common in satellite and airborne applications because of their low profile. The typically provide medium gain, omnidirectional performance for a single frequency or single band of frequencies. The simplest form of such an antenna consists of an extended thin flat sheet of metal with the slot adapted to radiate electromagnetic radiation.

The slot is excited by a voltage source such as a balanced parallel transmission line connected to the opposite edges of the slot, or a coaxial line. A typical bandwidth of a slot antenna might be as much as one octave but not more.

In one form they can typically consist of a circuit board with simply a connector fitted to the board and a randome covering the circuit board. The circuit board has a ground plane on one side of the board. The slot element is cut into the ground plane which is from where the radiating wave is propagated.

The slot element according to preferred embodiments of the invention is typically circular with its diameter (both inside and outside diameter and, amongst other things, the ratio between the two) determining the frequency of operation of the slot antenna element.

In general terms, the resonant frequency of an annular slot antenna is determined by $$\lambda g=2\pi R/n$$

where R is the median radius of the slot, n is an integer and λg is the wavelength on the microstrip line.

The patch element, or notch circuits as employed in some preferred embodiments of the invention, may be altered geometrically whilst achieving largely the same result. The nature of the patch elements is that they provide a loading and are generally dependent on a specific application. It ahs been found that a particular geometry and/or componentry results in the tuning of the frequency bands of interest. For example, providing a substitute bonding tape to adhere the device to a surface will generally provide a different dielectric effect and some small perturbations to the geometry will be required.

Accordingly, the geometry of the patch elements may be altered depending upon the components employed. For example, a change in the binding means of material, housing material or dimensions, or even the dielectric insulator may alter the response of the antenna. Equally, an alternative geometry may be arrived at in accordance with aspects of the present invention but with a different patch geometry. That is, there is no inherent ratio at play between the number of patch elements, or notches, and the number of bands over which the device may operate. Each patch has an effect on the tuning, and its is the combined load provided by the patches and other elements of the device which results in the desired tuning response.

For details of specific aspects of dimensions and design, reference is made to standard citations dealing with these topics which include, for example:

S. K. Palit, "Design and development of wideband microstrip antenna," IEEE Proceedings, 146, No. 1, pp. 35–39, February 1999;

Yongxi Qian, "A microstrip patch antenna using novel photonic band-gap structures" Microwave Journal 40, No. 1, January 1999;

Jasik, "Annular slot", Antenna Engineering Handbook, 2$^{nd}$ Edn, pp. 8/12–15, 1984;

Jean-Francois Zurcher, "Microstrip antennas", Broadband patch antennas, pp. 19–40, 1995;

Fujimoto, "Essential techniques in mobile antenna systems design", Mobile Antenna Systems Handbook, pp. 17–111, 1994;

K. Y. See, "Rigorous approach to modelling electromagnetic radiation from finite-size printed circuits structures" IEEE Proceedings, 146, No. 1, pp. 29–34, February 1999;

L. Zaid Kossiavas, "Dual-frequency and broadband antennas with stacked quarter wavelength elements", IEEE Transaction, 47, No.4, pp. 654–658, April 1999; and John Kraus, "Slot antenna" Antennas, 2$^{nd}$ Edn, pp. 624–628, 1988.

DESCRIPTION OF THE FIGURES

A preferred embodiment of the present invention will now be described, by way of example only, with reference to the accompanying figures in which.

DETAILED DESCRIPTION OF THE PREFERRED EMBODIMENTS

Figure 1:
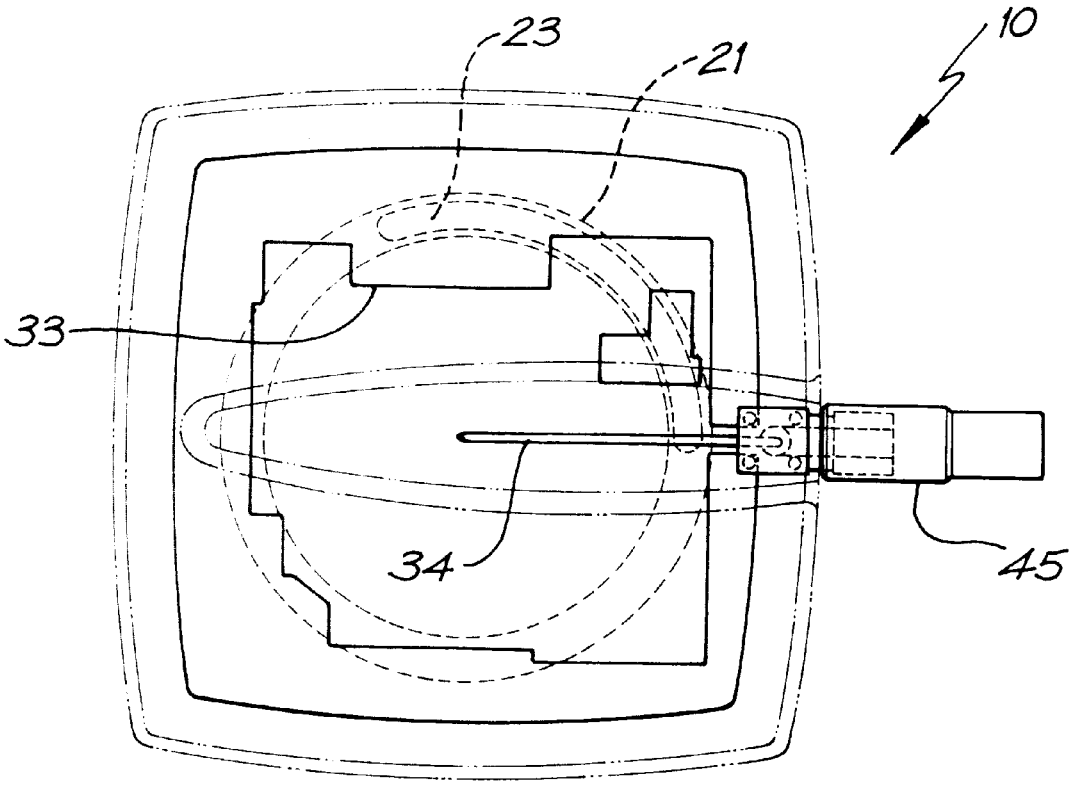
FIG. 1 is a plan view, partly in ghost view, of an assembled dual band antenna device according to one aspect of the invention.

Referring to the drawings in general there is illustrated an antenna device 10. More particularly, FIG. 1 illustrates a plan view, partly showing invisible features, of an assembled dual band antenna device 10. There is provided two generally planar antenna components having a PCB dielectric material disposed intermediate the components.

Figure 3:
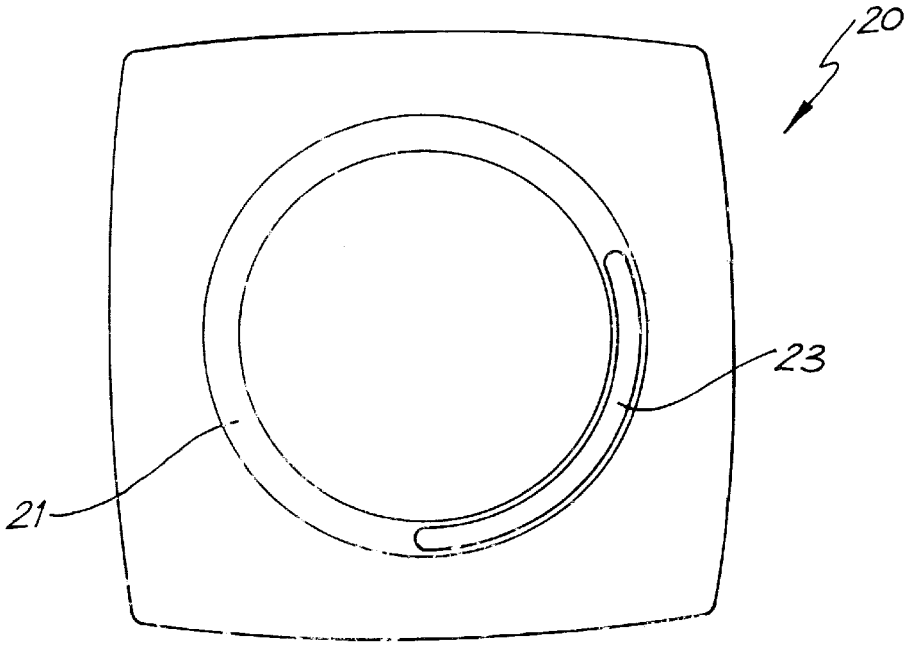
FIG. 3 is a plan view of a first annular slot antenna element of the dual band device of FIG. 1.

Referring also to FIG. 3, device 10 includes a first generally planar element 20 of predetermined dimensions in the form of a conductive material, preferably copper. In other embodiments, the conductive material is gold.

An annular slot 21 having a substantially constant radial separation is formed in copper element 20 and provides an annular slot resonant device. Slot 21 is symmetrically disposed on element 20, however. In other embodiments it is not symmetrically disposed. In yet other embodiments, slot 21 is of a predetermined shape wherein the radial separation is not constant. In other embodiments of the invention, a slot of non-annular configuration is employed.

Element 20 further includes a section of copper 23 having predetermined dimensions is disposed within a predetermined portion of annular slot 21 to assist in tuning the antenna device.

Figure 4:
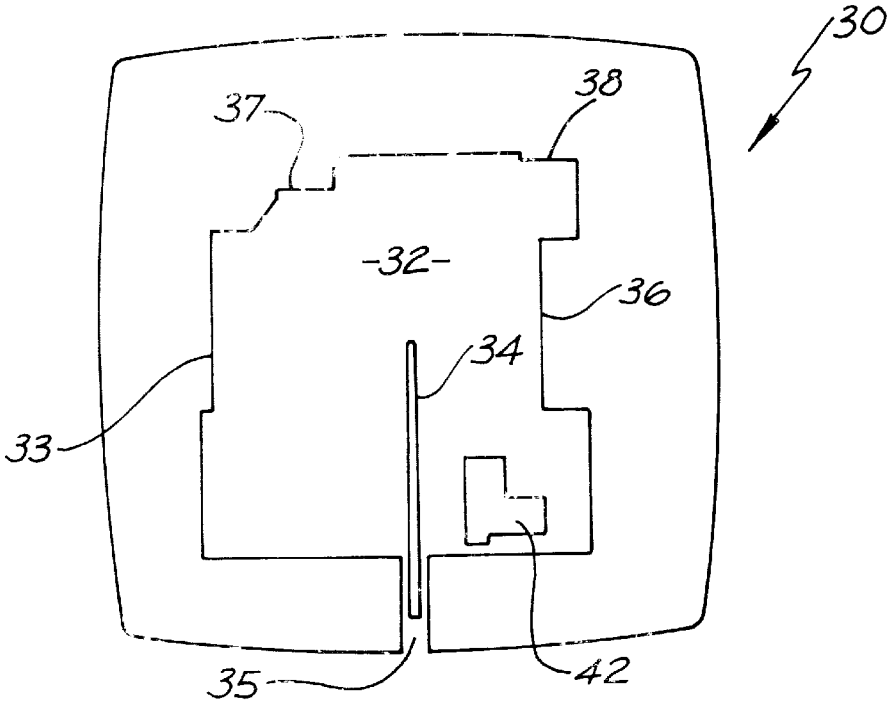
FIG. 4 is a plan view of a second notch circuit element for the dual band device of FIG. 1.

Referring also to FIG. 4, device 10 also includes a generally planar second, or lower resonant, element 30 which is also formed from copper. In other embodiments, the element is formed from some other suitable conductor.

Element 30 is a patch element which functions as part of a notch circuit. It includes a generally circular opening 32 with a strip opening portion 35 extending substantially radially form opening 32 to some predetermined length beyond the circumference of opening 32.

A conductive microstrip element 34 of predetermined dimensions radially extends from substantially the centre of opening 32 almost through strip opening 35.

A plurality of notch elements 33, 36, 37 and 38 generally inwardly radially extend into the generally circular opening 32. The notches are generally rectangular projections, however, in other embodiments they are of any predetermined shape. Element 42 is a parasitic element also used in the tuning of the notch circuit.

The precise location and shape of these notches is dependent on the tuning required and the specific intended application. The patch element, or notch circuits as employed in some preferred embodiments of the invention, may be altered geometrically whilst achieving largely the same result. The nature of the patch elements is that they provide a loading and are generally dependent on a specific application. It ahs been found that a particular geometry and/or componentry results in the tuning of the frequency bands of interest. For example, providing a substitute bonding tape to adhere the device to a surface will generally provide a different dielectric effect and some small perturbations to the geometry will be required.

Accordingly, the geometry of the patch elements may be altered depending upon the components employed. For example, a change in the binding means of material, housing material or dimensions, or even the dielectric insulator may alter the response of the antenna. Equally, an alternative geometry may be arrived at in accordance with aspects of the present invention but with a different patch geometry. That is, there is no inherent ratio at play between the number of patch elements, or notches, and the number of bands over which the device may operate. Each patch has an effect on the tuning, and it is the combined load provided by the patches and other elements of the device which results in the desired tuning response.

A generally planar dielectric material 41 is disposed intermediate elements 20 and 30. Material 41 is a PCB material, however, in other embodiments it is another suitable dielectric material.

Figure 2:
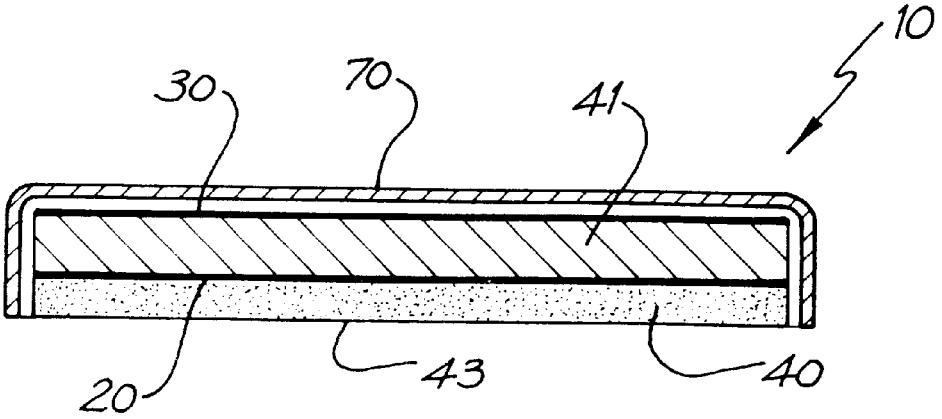
FIG. 2 is a sectional view through a part of the assembled device of FIG. 1.

As is best illustrated in FIG. 2, PCB material 41 has the first and second elements 20 and 30 integrally formed on opposed surfaces. In other embodiments, elements 20 and 30 are bonded to PCB 41 with double sided tape 40.

Elements 20 and 30 are encased in a protective housing 70 such that tape 40 has one surface exposed for mounting the antenna device to a dielectric material.

A connector 45, not illustrated in FIG. 2, is also provided for connection to an electric device in the form of a pre-amplifier, transceiver, or the like. The connector is configured for connection of the two elements 20 and 30 at one end and to a coaxial cable at the other. More particularly, connector 45 is in electrical communication with the first and resonant element at one end and configured for connection with coaxial cable at the other. However, the other end may be configured for connection to any suitable electrical cable.

Figure 5:
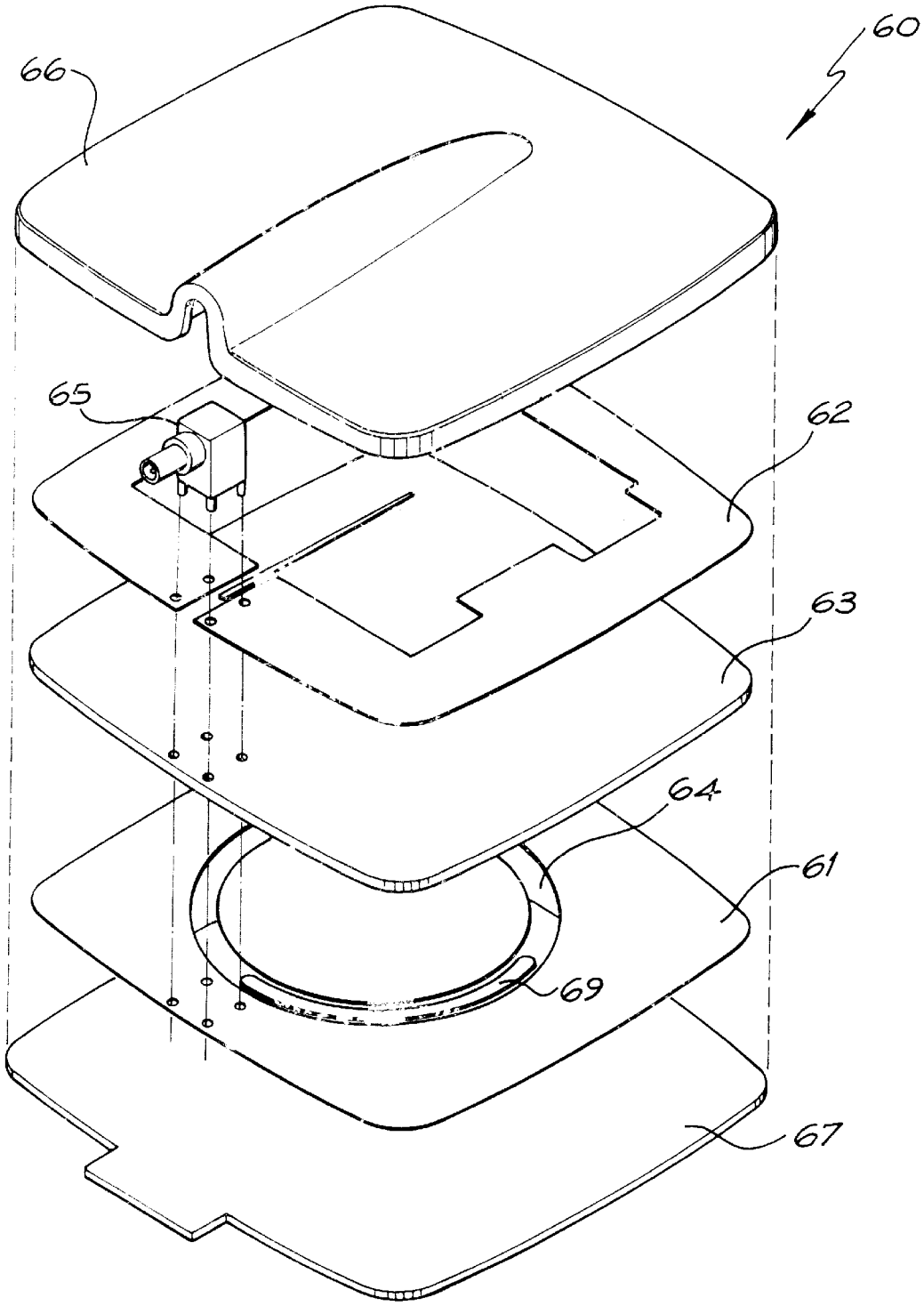
FIG. 5 is an exploded perspective view of a multiple band antenna device according to the invention.

Referring to FIG. 5, there is illustrated as exploded perspective view of a multiple band antenna device 60 which includes a substantially planar slot antenna 61 disposed adjacent to a substantially planar patch element 62. Device 60 further includes a substantially planar dielectric material in the form of dielectric material 63 disposed intermediate slot antenna 61 and notch circuit 62.

Patch element 62 includes two notches (not shown) such that the resonant frequency of the slot antenna 61 is altered allowing the device to transmit and/or receive RF signals over two frequency bands. In alternative embodiments, the number of notches and their shapes are of a predetermined number and shape corresponding to the number of frequency bands required to be employed by the device.

Slot antenna 61, patch element 62 and dielectric material 63 are bonded by double sided tape (not shown). In other embodiments, they are bonded by means of a glue or are integrally formed about the dielectric material.

Slot antenna 61 is substantially circular and defines an annulus 64 which has a substantially uniform thickness. In other embodiments, however, the slot is a slot of non-uniform shape.

A connector 65 is in electrical communication with slot antenna 61 patch element 62 at one end and configured at the other end for electrical connection to a coaxial cable. In other embodiments, the other end is configured for electrical connection to any suitable electrical cable.

Device 60 also includes a top cover 66 and a bottom cover 67. The covers are removably coupled such that the slot antenna 61, notch circuit 62 and dielectric 63 are encased in the covers. The covers releasably engage by means of complimentary locking formations(not shown). In other embodiments, bottom cover 67 is bonded to slot antenna 61, top cover 66 is bonded to patch element 62 such that the covers are adjacent and substantially encase antenna 61, patch element 62 and dielectric 63.

Figure 6:
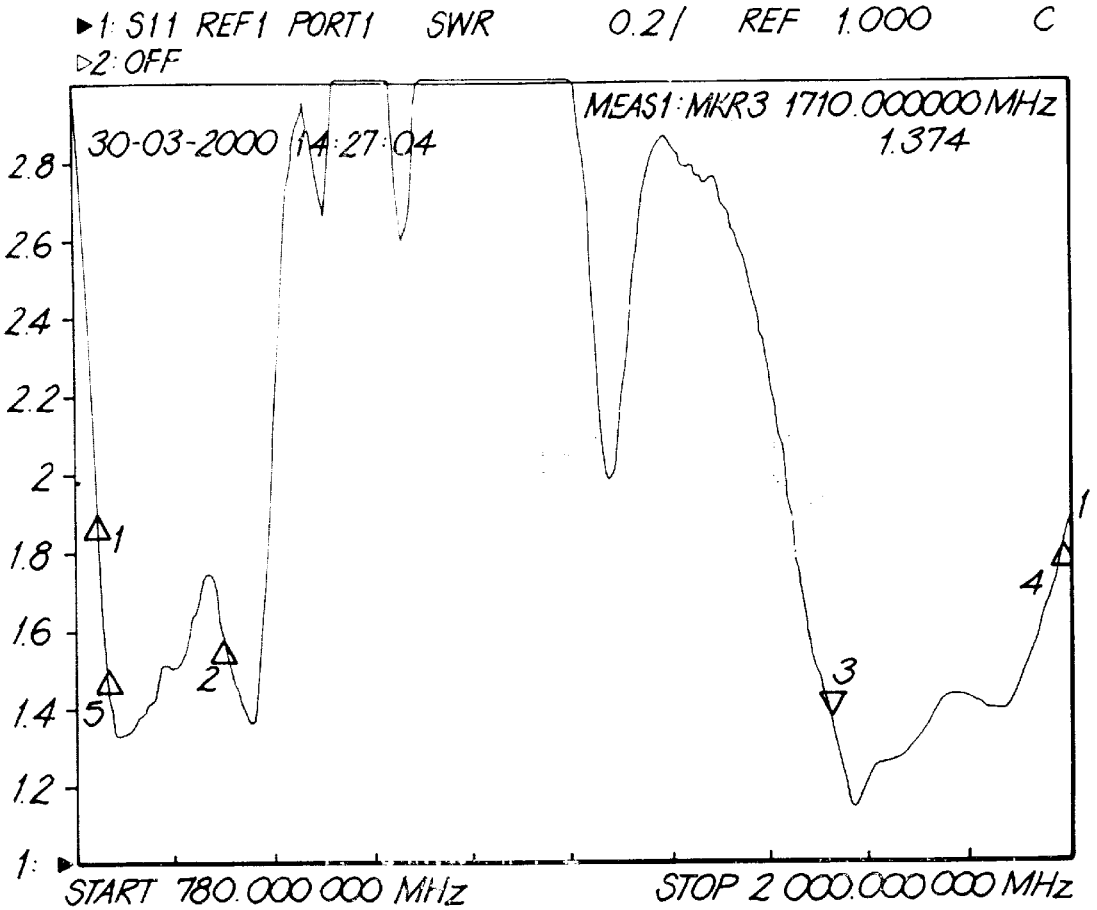
FIG. 6 is a graph showing the response of the device of FIG. 5 at frequencies from 880 to 1900 MHz of the device of FIG. 1.

FIG. 6 illustrates the response of the embodiment shown in FIG. 1 at frequencies from 880 to 1980 MHz. VSWR appears on the y-axis, and frequency on the x-axis. The resonances at 880–890 MHz, and at 1700–1900 Mhz are clearly visible.

In this embodiments, a small alteration in the size of the ground plane and the geometry of the patch circuits has altered the frequency response of the device significantly and in this form, a single antenna can be provided which will accommodate a large number of different operational bands, including in this particular derivation, 800 MHz SMR/Trunking, CDMA/AMPS/D-AMPS 800 MHz frequencies, 900 MHz GSM and DECT frequencies, 850–930 MHz ISM band frequencies, 1800 MHz GSM frequencies and the 1900 MHz GSM and PCS frequencies.

The principle of operation of the dual and multiple band devices will now be discussed in general terms. The power to the radiating element of a slot antenna is typically fed by a stripline or microstrip. The stripline employs a ground plane on the upper side of the board as its own ground reference and its central, active element is conducted along the other, otherwise essentially blank side of the circuit board. The central feed element extends past or through the slot element coupling energy into the slot and thus propagating radiation of the antenna. In other words, the stripline must extend on its separate plane to intersect the volume defined by the slot element in its respective plane.

The stripline active element is not physically connected in any other way to the slot, and the coupling of the energy into the radiating slot is simply an RF phenomena based on tuning the circuits to make this possible.

The length of the stripline element underneath the slot and indeed other dimensional characteristics of this element will have a substantial bearing on the effective frequency of the slot element and efficiency of energy coupling into that slot element. The theory of slot antennas is well known in the art of antenna design, and so the calculations will not be described in detail, but the interested reader is referred to the standard documents cited above.

In these arrangements, the coaxial connector or feed is usually fitted to one side of the board and the stripline element referred to earlier conducts the RF to the feed point of the slot antenna.

The notch circuit is not used to radiate, but is in fact used as a tuning tool. Referring to the embodiment of the invention illustrated in FIGS. 1 to 4, for example, a notch circuit is constructed around slot 21 of the antenna, the nature of the coupling of the stripline 35 into the slot antenna 21 is altered such that it now will couple at two frequencies into the slot antenna 21 and not just on one single band of frequencies. This arrangement allows the notch circuit to selectively effect a change in the resonance of the slot antenna 21 itself, allowing it to now radiate on the two frequencies.

The combination of the two RF elements, one used simply as a "tuning tool" is not previously known in the art, and allows a relatively independent selection of resonant frequency bands.

Patch antennas are widely used alone in the art. In a typical circuit board application, a patch antenna will consist of a large ground plane on one side in the circuit board defining the "underside" of the board. The notch circuit is provided on the upper side of the board and is usually slightly smaller than the ground plane. The notch circuit can be one of a plurality of geometric shapes, but tuned to a specific frequency band.

Energy can be coupled to the patch in a number of ways including a stripline or microstrip feed. Such a stripline feed typically includes a stripline with its reference ground connected to the ground plane side of the circuit board and its active central element drawn on the circuit board, conducting the energy across to the feed point of the patch itself. The energy may then be coupled into the patch element via either a direct physical connection or a simple coupling similar to that described for the slot antenna (which is an RF phenomena when all parameters are correctly maintained). In either case, (physical or non physical connection) the energy is thus coupled into the patch element and the wave is propagated by the patch in all cases in predominantly the opposite direction to the ground plane.

By changing the geometric shape of the active element of a patch antenna, it is possible to introduce two or more separate frequency bands and, in some cases, this can result in a dual band or multiple band antenna. The limitation to such an antenna is that the patch antenna itself would have to radiate at the fundamental lowest frequency. Moreover, the antenna is physically required to be of a minimum set of dimensions which are usually quite large and appropriate in the case of say a base station antennas but severely limiting in the case of a mobile antenna.

Printed patch antennas may use radiating elements of a wide variety of shapes including, for example, squares, rectangles, circles, rings and ellipses. More complex geometrical configurations and combinations of simpler shapes are also used for some particular applications. The selection of a particular shape depends on the parameters one wishes to optimise, for example bandwidth, sidelobes, cross polarisation and/or antenna size.

According to preferred embodiments of the present invention the basic antenna is the slot antenna. Unlike a patch antenna the slot antenna itself cannot be altered geometrically to meet the two frequency band or multiple frequency band requirement of the present invention. The inherent operational frequency band of the slot antenna is altered by tuning it using a mutual coupling mechanism.

In the implementation of FIGS. 1 to 4 the slot antenna (before all compensating issues have been resolved) was tuned to the higher of the two frequency bands of interest. The slot antenna was constructed and a notch circuit then added on the underside of the board. The notch circuit uses the same stripline feed. The stripline active element couples, in patch antenna terms, to the central disc on the slot antenna and also to a lesser degree to the surrounding copper on the upper side of the slot antenna.

In patch antenna theory, a larger ground plane is required on the underside of the patch. This was achieved by tuning the "ground plane" under the slot antenna using a series of geometric shapes. Using these shapes the notch circuit was effected and tuned, in conjunction with changes in the operating frequency of the slot antenna until as a combination the two gave the required result. This was possible because the patch antenna had a complemeritary "element" on the upper side of he slot. If it did not function as a "de-facto antenna" it would not tune.

The design of preferred embodiments of the present invention employs an unconventional approach, so as to use antenna theory to construct an antenna which functions more as a tuning circuit than as an antenna itself. The combination of the patch antenna (and acting as a notch circuit) and the radiating element, being an annular slot antenna, is unique, and achievable with only a single feed. When correctly compensated for in the physical antenna mounting arrangement, there is provided a physically small and very flexible product.

Preferred embodiments of the present invention have a wide range of possible applications. For example, the dual band version of the device described and illustrated herein can be used to allow a single transceiver or cellular telephone to operate in both the 900 MHz and 1800 MHz cellular telephone bands but a similar derivative of the device in a dual band form could be used to allow a single antenna to operate on any two other operational bands such as CDMA/AMPS/D-AMPS 800 MHz frequencies, PCS (1900 MHz band), UHF mobile radio, GPS Satellite, UHF or VHF Television or indeed in other frequency bands not described here.

This multiple band coverage device can therefore be used in most cellular systems currently in use in the world and could be further expanded in the future to accommodate the yet to be utilised but extremely valuable 2.1 GHz "Third Generation Mobile Phone" frequencies and the 2.4–2/5 GHz "Wireless LAN and ISM Band" frequencies.

The applications therefore for the invention are extensive in mobile applications where the antenna might be used for cellular telephony, two way radio applications and also in fixed applications where the antenna might find use as an antenna used for in-building reticulation of radio frequencies for cellular telephone and other applications. Further, the combination of the invention with GPS and other similar future technologies will extend the possible applications for the invention in both mobile and fixed installations which might be required either in the current or future RF environment.

Preferred embodiments of the present invention are structurally formed from inexpensive materials: PCB or other dielectric materials, adhesive tape and plastic casings. In combination, these provide a composite laminate suitable for use in high performance, UHF/low frequency microwave applications.

Preferably, the printed circuit board used is tetrafunctional epoxy/glass rigid laminate. This material has low water absorption, excellent UV-blocking performance, superior dimensional stability and high chemical resistance. Alternative PCB or other dielectric materials may be used if they provide suitable dielectric strength, loss factors and dimensional stability.

The outer casing is preferably made from ABS plastic material. Suitable materials include ASTALAC ABS with type number ASTALAC Z48 and ASTALOY ALLOY with type number ASTALOY M150.

The tape material may be a polyurethane foam attachment tape with high-performance acrylic on both sides. This is preferably a closed-cell polyurethane tape with acrylic adhesive on both sides. Such a foam is energy dissipating and highly conformable, which makes it especially useful for applications involving mismatched surfaces and extreme temperatures. Any tape selected should provide excellent aging properties and environmental resistance against weathering, extreme temperatures, UV exposure, oxidisation and ozone.

An alternative construction could use a suitable adhesive directly on top of the PCB 41, to replace tape 39.

Another alternative construction might include a larger printed circuit board or casing which could be screwed or attached by other means to any dielectric surface.

It is emphasised that the properties of the PCB, tape and casing need to be taken into account in the design process, as they will affect the resonant frequency of the antenna. The resonant frequency may shift 20 MHz or more in one or more of the intended operational bands depending on the materials chosen and the proximity of these materials to the radiating element of the antenna device.

It will be appreciated that the present invention is capable of implementation in various ways, and that the implementation described is intended only to be illustrative and exhaustive. In particular, it is intended that a GPS satellite geo-location antenna may be added to the antenna device in order to combine the functionality of a GPS antenna and a cellular telephone antenna in a single housing.

Although the invention has been described with reference to specific examples, it will be apparent to those skilled in the art that the invention may be embodied in many other forms.

The claims defining the invention are as follows:

1. An antenna device including:

a first conductive element having a slot which forms a closed path and includes a section of conductive material disposed in a portion of the slot;

a second conductive element disposed adjacent the first element and having a central opening and a strip opening extending from the central opening to some predetermined length beyond the edge of the opening, a conductive strip feed element disposed in the strip opening and at least two notches of predetermined dimensions generally radially inwardly extending into the central opening;

a dielectric insulator disposed intermediate the conductive elements such that, in use, the device has at least two frequency bands to receive and/or transmit RF signals.

2. A device according to claim 1 wherein the first and second conductive elements and the dielectric insulator are generally planar and including a pair of major faces.

3. A device according to claim 2 wherein the first and second conductive elements are bonded to respective major faces of the dielectric insulator.

4. A device according to claim 3 wherein the first and second conductive elements are bonded to the dielectric insulator with double sided tape.

5. A device according to any one of claims 3 wherein the slot is circular and defines an annulus.

6. A device according to claim 5 wherein the slot has a uniform thickness.

7. A device according to claim 2 wherein the first and second conductive elements are integrally formed on respective major faces of the dielectric insulator.

8. A device according to claim 7 wherein the slot is non-symmetrical.

9. A device according to any one of the preceding claims wherein the dielectric insulator is a PCB material.

10. A device according to any one of the preceding claims wherein the central opening is substantially circular.

11. A device according to claim 10 wherein the notches are of different shapes.

12. A device according to any one of the preceding claims for use in CDMA, TDMA, PDS, third generation mobile and/or AMPS telecommunications systems, UHF and/or VHF televisions systems, and/or GPS satellite navigation systems.

13. A device according to any one of the preceding claims wherein the conductive elements include copper.

14. A device according to claim 13 wherein the selection of the encasing material assists in tuning the resonant frequency or frequencies of the device.

15. A device according to any one of the preceding claims which is removably encased in a dielectric material.

16. An antenna device including:

a slot antenna having a closed path slot; a patch element; and a dielectric material disposed intermediate the slot antenna and patch element, wherein the patch element is selectively configured such that the resonant frequency of the slot antenna is altered allowing the device to transmit and/or receive RF signals over at least two frequency bands.

17. A device according to claim 16 wherein the patch element is a notch circuit.

18. A device according to claim 17 wherein the notch circuit includes four notches.

19. A device according to claim 18 wherein the notches are of different shapes.

20. A device according to claim 19 wherein the device, in use, transmits and/or receives RF signals over four frequency bands.

21. A device according to claim 20 wherein the notch circuit and slot antenna are bonded by means of double sided tape.

22. A device according to claim 18, wherein the notch circuit and slot antenna are respectively bonded to the dielectric material.

23. A device according to claim 18 wherein the notch circuit, slot antenna and dielectric material are integrally formed.

24. A device according to any one of claims 17 to 20 wherein the notch circuit, slot antenna and dielectric material are all generally planar.

25. A device according to any one of claims 16 to 21 wherein the slot is circular and defines an annulus.

26. A device according to claim 25 wherein the slot has non-uniform thickness.

27. A device according to claim 26 wherein the notches are of different shapes.

28. A device according to any one of claims 16 to 25 for use in CDMA, TDMA, PDS, third generation mobile and/or AMPS telecommunications systems, UHF and/or VHF television systems, and/or GPS satellite navigation systems.

* * * * *

UNITED STATES PATENT AND TRADEMARK OFFICE

CERTIFICATE OF CORRECTION

PATENT NO. : 6,346,919 B1
DATED : February 12, 2002
INVENTOR(S) : Daniel Wang et al.

It is certified that error appears in the above-identified patent and that said Letters Patent is hereby corrected as shown below:

Column 9,
Line 54, please delete "any one of claims 3" and insert therefore -- claim 3 --

Column 10,
Lines 3, 5, 9, 14 and 16, please delete "any one of the preceding claims" and insert therefore -- claim 1 --
Line 7, please insert a -- , -- after the number "10"
Line 47, please delete "any one of claims 17 to 20" and insert therefore -- claim 18 --
Line 50, please delte "any one of claims 16 to 21" and insert therefore -- claim 17 --.
Line 56, please delete "to any one of claims 16 to 25" and insert therefore -- claim 17 --

Signed and Sealed this

Thirtieth Day of July, 2002

*Attest:*

*Attesting Officer*

JAMES E. ROGAN
*Director of the United States Patent and Trademark Office*